US005406809A

United States Patent [19]

Igelmund

[11] Patent Number: 5,406,809

[45] Date of Patent: Apr. 18, 1995

[54] MECHANICAL SECURITY FIXTURE FOR PERSONAL COMPUTERS

[76] Inventor: Darrell A. Igelmund, 3602 Lake Washington Blvd. North, Renton, Wash. 98056

[21] Appl. No.: 888,733

[22] Filed: May 26, 1992

Related U.S. Application Data

[63] Continuation-in-part of Ser. No. 698,971, May 13, 1991, abandoned.

[51] Int. Cl.[6] ..... E05B 73/00

[52] U.S. Cl. ..... 70/2; 29/451; 29/453; 70/18; 70/58; 248/552; 292/281; 361/679; 403/282; 439/135

[58] Field of Search ..... 70/2, 3, 6, 18, 30, 70/49, 57, 58; 403/282; 292/281, DIG. 53, DIG. 64; 248/551, 552, 553, 917; 439/135, 304, 501; 29/451, 453; 361/380, 679; 364/708, 708.1

[56] References Cited

U.S. PATENT DOCUMENTS

| | | | |
|---|---|---|---|
| 682,657 | 9/1901 | Wirf | 292/281 |
| 2,709,290 | 5/1955 | Rosenthal | 29/451 |
| 3,972,110 | 8/1976 | Sasena | 29/453 X |
| 3,984,075 | 10/1976 | Bahner et al. | 70/58 X |
| 4,212,175 | 7/1980 | Zakow | 70/58 |
| 4,418,550 | 12/1983 | Hamilton | 70/2 X |
| 4,570,465 | 2/1986 | Bennett | 70/18 |
| 4,680,949 | 7/1987 | Stewart | 70/14 |
| 5,004,867 | 4/1991 | Mast | 174/35 GC |
| 5,076,619 | 12/1991 | Chi | 292/17 |
| 5,228,319 | 7/1993 | Holley et al. | 70/58 |

FOREIGN PATENT DOCUMENTS

| | | | |
|---|---|---|---|
| 5705 | 1/1893 | United Kingdom | 292/281 |
| 1173603 | 12/1969 | United Kingdom | 248/552 |

*Primary Examiner*—Lloyd A. Gall
*Attorney, Agent, or Firm*—Michael J. Folise

[57] ABSTRACT

A novel fixture (8) for securing personal computers has a tether cable (10) connected to a loop portion (13) which is in turn connected to an expansion slot cover plate (12) for a personal computer. Once the fixture (8) is installed in an expansion slot opening (15) of a personal computer, the computer is secured if the tether cable (10) is attached to a fixed location such as a table (16) using a padlock (17).

12 Claims, 4 Drawing Sheets

FIG. 3
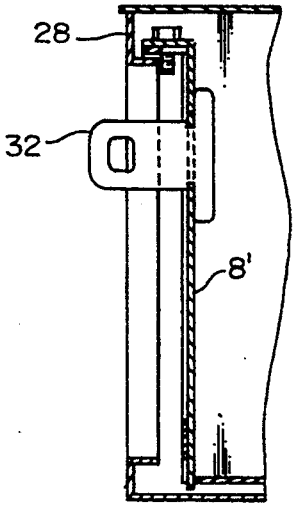
FIG. 4
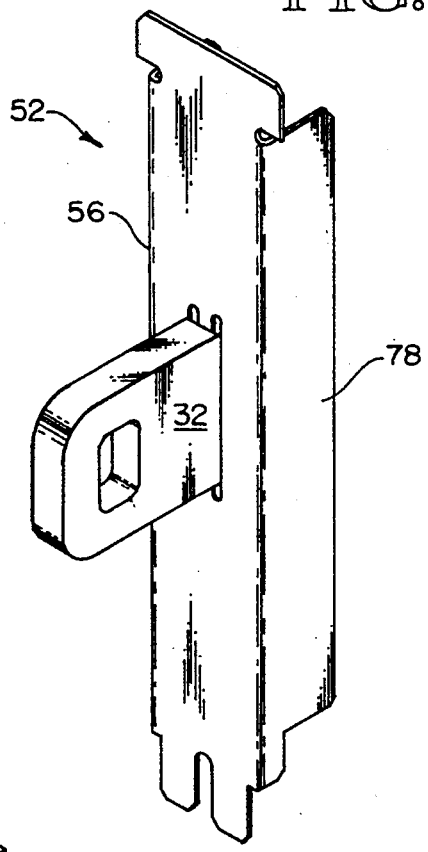
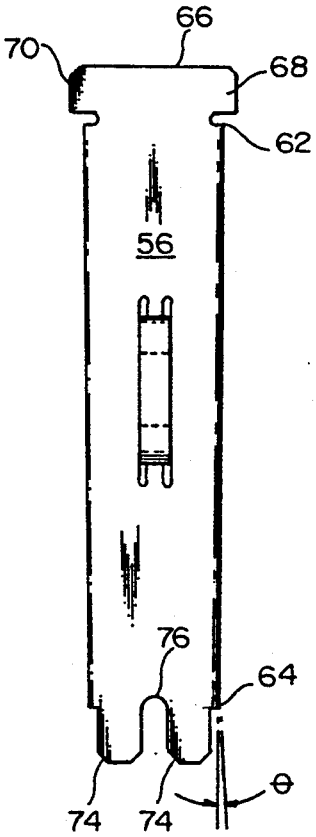
FIG. 5
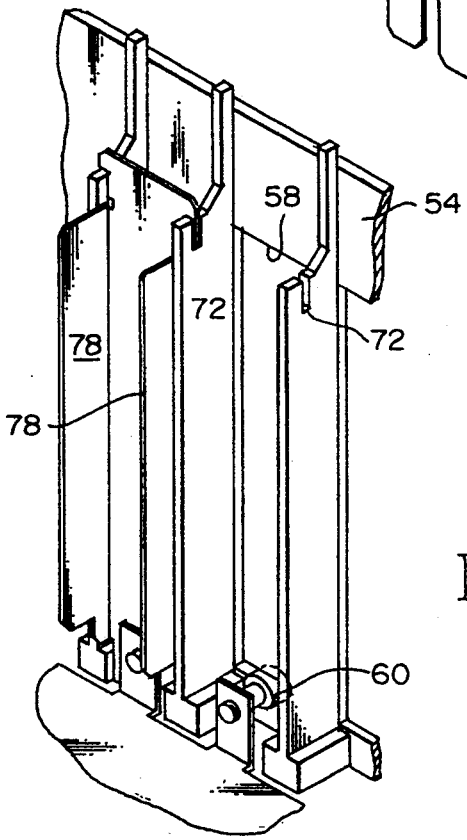
FIG. 6

FIG. 7
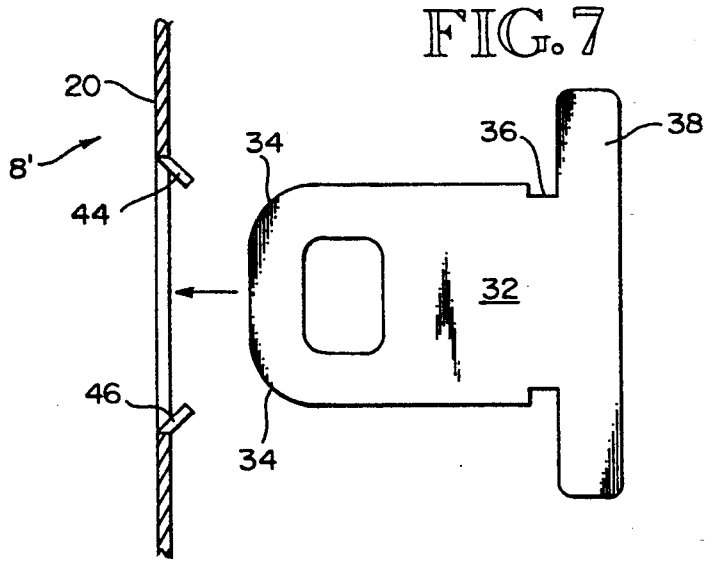
FIG. 8
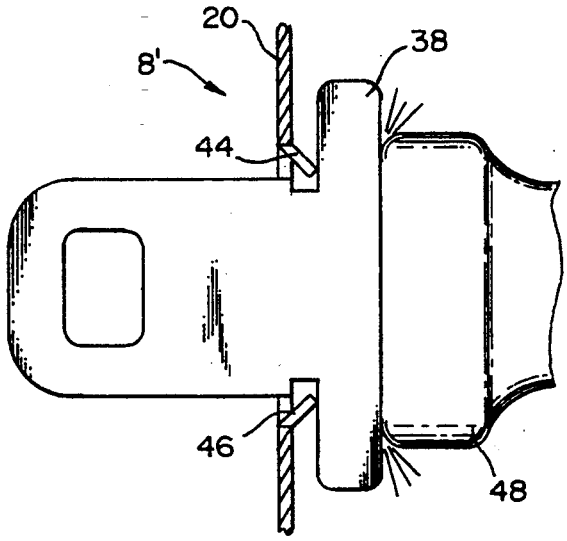
FIG. 9
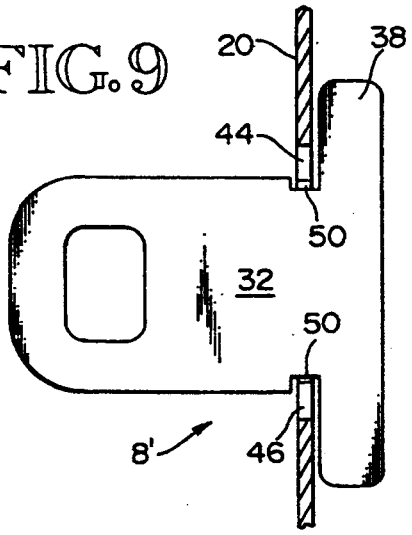
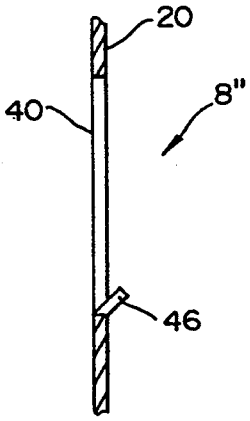
FIG. 10

MECHANICAL SECURITY FIXTURE FOR PERSONAL COMPUTERS

This application is a continuation in part of my application Ser. No. 698,971 filed May 13, 1991, now abandoned.

TECHNICAL FIELD

This invention relates to office equipment security devices, specifically to such devices used to anchor personal computers from relocation or theft.

BACKGROUND—DESCRIPTION OF PRIOR ART

The potential of theft or damage to personal computers has caused consumers to resort to a wide variety of security methods. Heretofore, the available security solutions for personal computer users were general purpose in nature and largely based on designs that were developed for the general office equipment marketplace. Because office equipment including personal computers seemingly varied in size, shape, and construction, inventing a common security solution for these items have proved elusive. As an example, typewriters vary so dramatically that it is impossible to come up with a common method either to bolt them to a table or to attach a steel cable to them. Consequently, a user must determine, based on his or her particular equipment, what device is the best. Generally, the selection involved compromises. Prior art discloses many efforts to provide broadly applicable security devices, none of which provide a common, inexpensive and secure method to protect personal computers. One particular class of devices utilize adhesive with interlocking plates to glue the bottom of the office equipment to the work surface. U.S. Pat. No. 4,655,429 to Gaenzle et al. (1987) discloses a fixture that uses plates and a bonding method to secure them. Other methods have the user drill holes in the desk to bolt the interlocking plates together from underneath the table. These methods are satisfactory for certain high risk applications but generally are unacceptable because they make movement of the equipment time consuming and difficult when offices are relocated; sometimes force permanent modifications to be made to the equipment or anchoring location; and do not allow the user the latitude to even slightly reposition the equipment once it has been installed. In addition, any of these devices must be manufactured to fit the specific geometry of the machines they secure, making them expensive to manufacture and buy.

Another class of devices that share many of the same drawbacks encase the equipment to be protected in a protective housing using various methods to anchor the housing to a secure location. Several types of these devices have been disclosed—for example U.S. Pat. No. 4,123,922 to Kuenstler (1978) describes various means to lock equipment inside a protective housing. U.S. Pat. No. 4,252,007 to Kerley (1981) discloses a protective housing of similar intent but different design. Although appropriate for high risk applications, these devices must be designed to house a particular size of equipment making them expensive to manufacture and sell. They have the added drawback of dramatically altering the way the office equipment looks and in some instances feels; making them unattractive; and creating a less than positive environment for the office staff that operates the equipment. My own U.S. Pat. No. 4,843,848 (1989), although less encasing than those described above, also suffers from the problem of being geometrically specific to the equipment it is protecting.

To overcome these objections, consumers have resorted to security devices that have more flexible anchoring methods. Many of these devices utilize steel cable, sometimes referred to as wire rope, to tether personal computers in place. Some steel cable devices can use adhesive as the method to attach the cable to the office equipment. Generally, this involves a plate that is bonded to the equipment with adhesive. The cable is then attached to the plate. U.S. Pat. No. 4,733,840 to D'Amore (1988) discloses one such device that uses a bendable member as part of the plate. This method of anchoring is somewhat advantageous because it is usable across a wide variety of office equipment and is easily installed. Furthermore, the cost of manufacture is low. The disadvantages to the adhesive plate approach are sometimes quite severe. To provide a strong bond, adhesive requires a smooth, flat and clean surface. The majority of personal computer surfaces are rough and covered with slick coatings (polyurethane enamels or silicone). Consequently, the degree of security provided by adhesive plates is always questionable and unpredictable.

Another steel cable device uses existing screws to secure the cable to the office equipment. First, a bracket is mounted to the equipment using an existing screw. Then the steel cable is passed through the bracket, blocking removal of the screw. These devices can be used on a broad variety of computers; are inexpensive to manufacture; and can be removed when no longer desired. They, however, have disadvantages. First, the security provided by this method is based on the strength of the screw arrangement which anchors the bracket. Most personal computers have relatively small, frail screws. Additionally, the surfaces that they screw in to are generally of the thin, sheet metal variety. Consequently, a thief, depending on the personal computer, could dislodge the bracket with a good quick tug. Another disadvantage is the difficulty that users encounter mounting these devices. Many users have a difficult time visualizing how these devices are utilized and installed.

Another steel cable device uses a tether to anchor a housing that encases the equipment. This approach has the same drawbacks as the other protective housing approach that was mentioned above. They dramatically alter the look and feel of the equipment they are protecting and create a negative image in the workplace.

Still other office equipment steel cable devices as disclosed in U.S. Pat. Nos. 3,785,183 to Sander (1974); 3,859,826 to Singer et al. (1975); 3,990,276 to Shontz (1976); and 4,300,371 to Herwick et al. (1981) all focus on elaborate keylock assemblies but do not focus on, or provide any insight into a simple and common method to attach the steel cable to a personal computer or other office equipment. For attaching the cable to equipment to be secured, Sander suggests making a hole in the equipment to take advantage of the disclosed lock and back plate assemblies. Most users find this unacceptable because they do not wish to drill a hole for fear of violating the warranty or damaging the equipment. Singer et al. suggests using tamperproof screws to attach to the equipment to take advantage of the disclosed locking assembly. This assumes that there are suitable screw mounting locations that are in the necessary location to mate with the particular security plate for the equipment. Additionally, security screws are only suitable as long as a thief does not have the correct screwdriver. Shontz suggests drilling a hole in the office equipment; or finding a suitably located and sized hole; or adapting a plate to fit existing nuts and bolts to mount the cable as to take advantage of the disclosed locking assembly. This approach has many of the same disadvantages that are found in the Sander disclosure.

OBJECT AND ADVANTAGES

Accordingly, I claim the following as my objects and advantages of the invention:

(a) to provide a security fixture that can be easily and inexpensively installed on virtually all personal computers in existence without regard to the shape of the personal computer or the availability of anchor screws;

(b) to provide a security fixture that does not require any special skill to install and is easily understood by the majority of personal computer users;

(c) to provide a security fixture that allows the user the convenience to readjust the personal computer for personal comfort and that is easily removable when no longer desired;

(d) to provide a security fixture whose strength is not dependent on the outside surface texture or slickness of the computer or the strength of the existing screws on the outside of the computer;

(e) to provide a security fixture that does not alter the look and feel of the personal computer;

(f) to provide a security fixture that does not require any permanent modifications to the computer.

In addition, I claim the following additional objects and advantages: to provide a mechanical security fixture which uses a unique method to provide a remarkably high strength, low cost method of attaching the cable to the computer. Readers will find further objects and advantages of the invention from the consideration of the ensuing description and the accompanying drawings.

The above objects and advantages are accomplished by providing a mechanical security fixture that mounts to a location on the personal computer that, prior to this invention, was used solely for expanding the electronic capability of the personal computer. This location is commonly referred to as the "expansion slot" area of the personal computer and can be recognized by the rectangular openings that are generally on the right side of the back of a personal computer. The invention uses this location for 3 reasons. First, commonality: Computer manufacturers provide expansion slots to allow the user to expand the computer with various hardware devices like modems, printer ports, etc. As the personal computer market matured, other computer manufacturers also adopted these same standards. Consequently, expansion slots are to be found on virtually all personal computers. Second, strength: The structure of the expansion slot opening at the back of the computer allows the invention to be inserted from inside the computer, thereby taking advantage of the integrity of the metal computer case itself to hold the mechanical fixture in place...much more secure than the previously mentioned adhesive mount and screw mounted methods. Third, low cost: The mechanical security fixture invention itself is a relatively simple device that can be produced at low cost.

DRAWING FIGURES

FIG. 3 is a section, side elevational view of an alternate embodiment of the invention shown in FIGS. 1 and 2.

FIG. 4 is an isometric view of a second embodiment of the invention for use with PS/-2 type computers.

FIG. 5 is a front elevational view of the embodiment shown in FIG. 4.

FIG. 6 is a rear, isometric view of the embodiment shown in FIGS. 4 and 5 installed in the chassis of an PS/-2 type computer.

FIGS. 7–9 are enlarged, side elevational views illustrating a method for constructing the alternate and second embodiments of the invention.

FIG. 10 is a side elevational view, similar to FIGS. 7–9 showing an alternate construction technique for the method shown in FIGS. 7–9.

DESCRIPTION OF THE PREFERRED EMBODIMENTS

Figure 2:
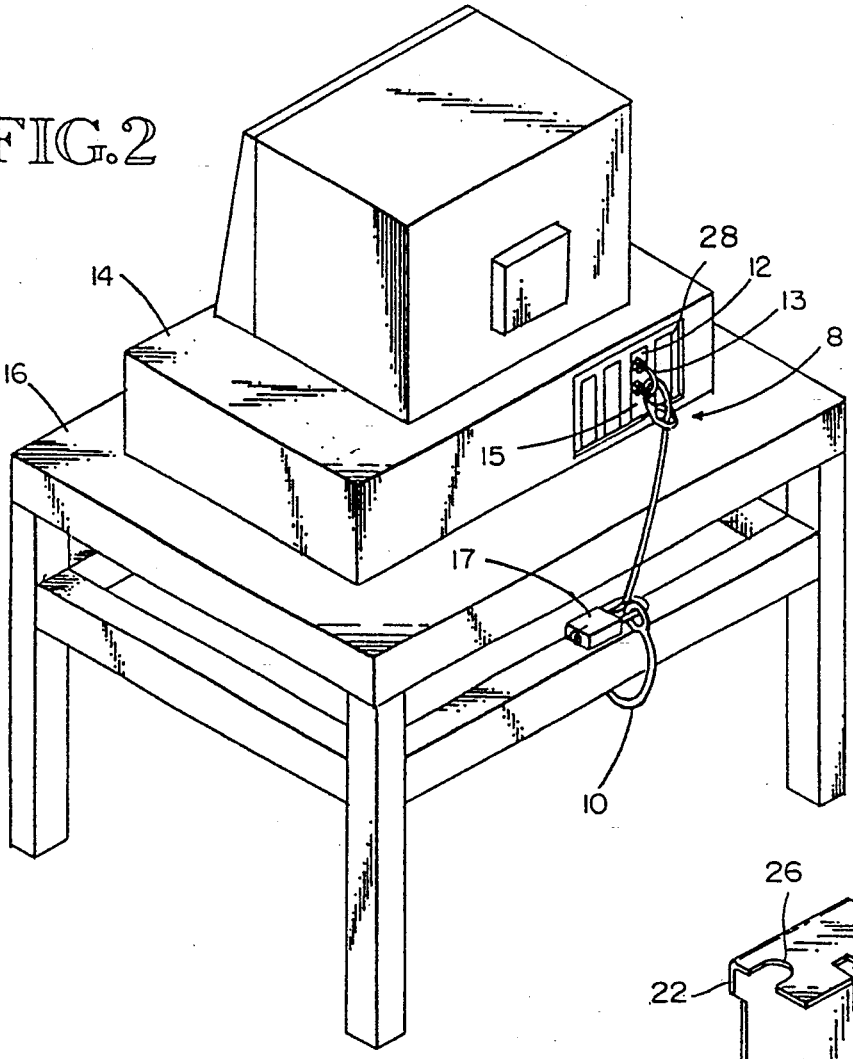
FIG. 2 is an isometric view of the invention shown in FIG. 1 attached to a personal computer with a steel tethering cable securing the unit to the table.

FIG. 2 shows a mechanical security fixture for personal computers, generally designated 8, constructed in accordance with the present invention. The fixture is attached to a personal computer 14 to prevent the personal computer from being removed from a desired location.

Figure 1:
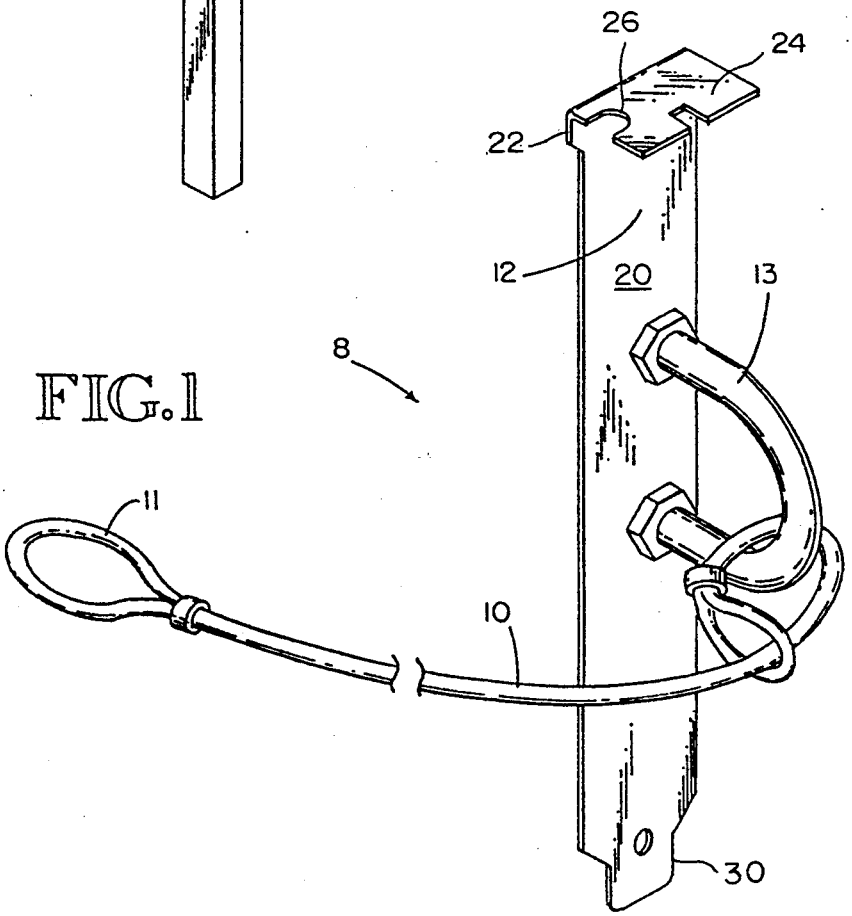
FIG. 1 shows a perspective view of the mechanical , security fixture for XT/AT type personal computers according to one embodiment of the invention.

Referring to FIG. 1, the fixture may include an expansion slot opening cover plate 12 which is about 120 mm long, 19 mm wide, with a thickness of about 0.75 mm and is generally sized and bent to conform with the industry standard dimensions to function as a expansion slot opening cover plate. A mechanical locking relationship may be established between a tether cable 10 and the plate 12 by providing a cable attachment loop or loop portion 13. As used herein, the words "loop" and "loop portion" are deemed interchangeable. Cable 10 is preferably made of stranded steel covered with a vinyl coating and may be about 120 cm in length. Each end of the cable 10 may be terminated with a tether cable loop end 11 about 50 mm in diameter.

FIG. 2 shows the invention securing a typical personal computer installation. The fixture 8 is installed in the personal computer 14 using a personal computer expansion slot opening 15. As stated above, expansion slots and their openings generally conform to industry standards such as the ISA (Industry Standard Architecture) standard for 16 bit machines and the EISA (Enhanced Industry Standard Architecture) standard for 32 bit machines. The width of the plate 12 may be larger than the width of the slot opening 15 such that the plate 12 cannot be pulled through the slot opening 15. The cable 10 may be attached to the fixture using the loop 13 and may be locked to a table 16 using a padlock 17.

As stated above, the fixture 8 includes a cover plate 12 sized to conform with industry standard dimensions for an expansion slot opening cover plate. Stated in another way, the cover plate is sized and configured to be received in an expansion slot opening 15 of a conventional AT/XT type personal computer expansion slot chassis opening. The dimensions of expansion slots of this type are substantially standard in the industry. The cover plate 12 is therefore formed from a heavy gauge material, preferably No. 1010 cold rolled steel which is significantly stronger than the cover plate blanks supplied with many AT/XT type personal computers. The cover plate has a substantially planar main body 20 which is substantially constant in width between 1.8 and 1.9 centimeters.

The upper end of the main body terminates in a laterally displaced segment 22 having a height of approximately 0.6 centimeters and a lateral displacement of 0.3 centimeters with respect to a longitudinal, central axis defined by the main body 20. The laterally displaced segment 22 terminates in a transversely extending flange 24 having the same width as the main body 20. The flange defines at least a portion of an aperture 26 for accepting a screw. The flange 24 and aperture 26 mate with a corresponding proportion of an expansion slot chassis indicated as reference numeral 28 in FIG. 2, for securing the fixture 8 within the chassis.

The lower end of the main body 20 terminates in a downwardly depending tongue 30 having a reduced width of approximately 1 centimeter and a length of approximately 0.7 centimeters. The tongue is sized to be received in a slot in a lower portion of the expansion slot chassis 28. Once installed, the plate cannot be pulled through the expansion slot opening 15 because of the excessive width and particular shape of the cover plate.

Figure 11:
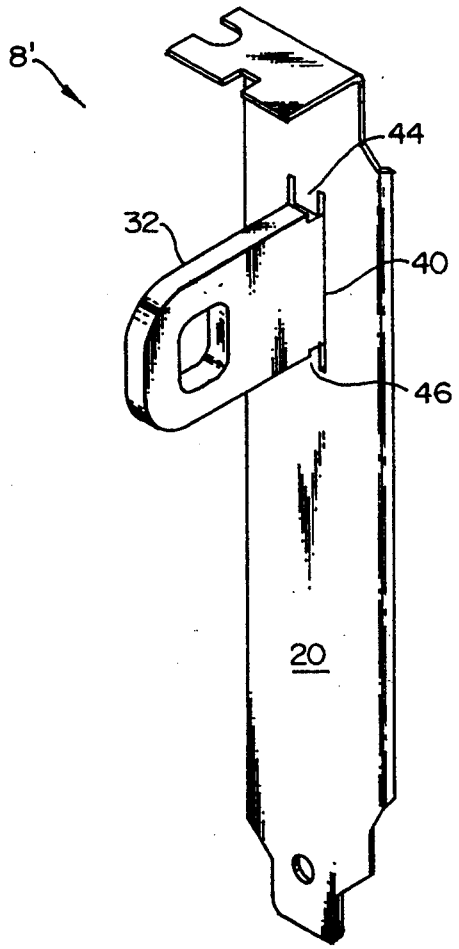
FIG. 11 is an alternate embodiment of the invention shown in FIGS. 1 and 2.

FIG. 11 illustrates an alternate embodiment 8' of the fixture shown in FIGS. 1 and 2. In FIG. 11, the loop portion 13 of FIG. 1 has been replaced with a t-shaped nose piece 32. As best seen in FIGS. 7–9, the nose piece has curved forward edges 34, a constricted waist section 36, and an elongated rear section 38. The alternate embodiment 8' is otherwise identical to the embodiment shown in FIGS. 1 and 2 except that the main body defines an aperture 40 having upper and lower inwardly depending tabs 44, 46.

As shown in FIG. 7, the main body is first formed with an aperture having a length of approximately 2.5 centimeters. The tabs are bent rearwardly at an angle of approximately 45° and have a length of three millimeters. The nose piece 32 has a height of approximately two centimeters, but a height of approximately only 1.7 millimeters at the mid-point of the curved forward edges 34. Therefore, as shown in FIG. 8, the curved forward edges splay the tabs 44, 46 outwardly until the rear section 38 is encountered. A sharp blow from a hammer, such as 48, seats the tabs within a shoulder 50 formed by the intersection of the nose piece 32, waist 36, and rear section 38. The nose piece is therefore restricted against forward motion by the reaction of the rear section against the main body 20. The nose piece is preferably manufactured from quarter inch thick steel stock and thus forms an extremely strong structure against forward movement. The nose piece is moderately restrained against rearward movement by the tabs 44, 46. However, such rigidity is inconsequential from a security point of view in which only forward motion of the nose piece with respect to the cover plate, or the cover plate with respect to the personal computer chassis is to be avoided.

FIG. 10 illustrates an alternate embodiment 8'' of the structure shown in FIGS. 7–9 and 11 in which the height of the aperture 40 has been reduced approximately by the length of one tab. In this embodiment, only a lower tab 46 (or alternately only an upper tab 44) is provided. The method for inserting the nose piece 32 is identical with that described in association with FIGS. 7–9. In any of the embodiments disclosed above, the tongue 30 can be deleted, although the structure may not be as secure.

FIGS. 3–6 describe a second embodiment 52 of the invention intended for use with PS/-2 type personal computers. Computers of this generic type employ an expansion slot chassis 54 of a substantially different construction from the XT/AT type expansion slot chassis 28 shown in FIG. 2. Therefore, the main body 56 of this embodiment is of substantially different construction from the main body 12 shown in FIGS. 1 and 11. In addition, due to the peculiarities of the PS/-2 expansion slot chassis, the main body 56 is substantially different in construction from that of the blank plates supplied by the personal computer's manufacturer. The blank plates supplied with this type of personal computer are of a flimsy construction and are dimensionally configured so as to be forwardly removable from the expansion slot opening 58 if the expansion slot plate mounting screw 60 is removed. Therefore, the main body 56 is designed and constructed so as to be substantially rigid, and dimensionally incapable of being pulled through the opening 58 even if the mounting screw 60 is released.

As best seen in FIGS. 4 and 5, the main body has at its upper end 62 a width of approximately 1.9 centimeters. At its lower end 64, the main body has a slightly narrower width of approximately 1.7 centimeters, thus forming a tapered angled $\theta$ of approximately 0.7°. This shape facilitates insertion of fixture 52 into the chassis 58.

The upper end 62 has an upwardly and laterally outwardly directed tab portion 66 having a height of approximately 0.8 centimeters and a width of 2.3 centimeters. The ears 68, 70 formed by the extra width of this tab portion over the main body 56 reside in grooves 72 in the chassis 54. The lower end 64 terminates in downwardly depending prongs 74 having a length of approximately 0.7 centimeters so as to form an elongated slot 76 to accept the mounting screw 60 as shown in FIG. 6. This mounting screw provides little or no security as it is accessible from the outside of the personal computer. Therefore, the shape and geometry of the fixture 52 must perform this function. To this end, the main body 56 is provided with longitudinal, rearwardly and transversely extending sidewalls 78. The sidewalls have a length of approximately 8.2 centimeters and a depth of approximately 1.2 centimeters. These sidewalls and main body therefore form a "U" or "C" shape channel in cross section. The cross-sectional hypotenuse or diagonal of this channel is approximately 2.2 centimeters at the upper end 62 which is larger than the maximum 2-centimeter wide opening 58 in the chassis 54. Thus, even if the screw 60 is loosened from outside the computer, no matter how the fixture is twisted or re-oriented, it cannot be pulled through the opening. In contrast, the "blank plates" supplied with the computer have sidewalls with a depth of approximately 0.4 centimeters generating a diagonal dimension of substantially less than 2 centimeters. Therefore these blank plates, even if they were manufactured to be substantially strong could readily be re-oriented and pulled through the opening 58. The nose piece 32 shown in FIGS. 4 and 5 is otherwise identical to that shown in FIGS. 3–9 and 11, and the construction technique is identical to that shown in FIGS. 7–10. The main body 56 of embodiment 52 is also preferably manufactured from No. 1010 cold roll steel having a thickness of 0.75 millimeters. In this second embodiment, the sidewalls can be reduced in depth or eliminated if the nose piece 32 is relatively rigidly fixed to the main body such as by welding. In addition, the prongs 74 can be deleted because the screw 60 does not provide any security function.

OPERATION—FIGS. 1 AND 2

Users of the mechanical security fixture of FIG. 1 will employ it to protect personal computers from theft or relocation. The invention installs quickly and easily in a similar fashion to installing any personal computer expansion slot accessory. There is no risk of voiding warranties by modifying the computer in any way.

FIG. 2 shows a personal computer 14 secured with the invention. To secure the personal computer 14 to a table 16, the lid to the personal computer 14 is removed, and a mechanical security fixture 8 is installed in any unused expansion slot opening 15. This installation process is the same installation process that is used to install any expansion slot accessory into a personal computer and is covered in detail by every computer manufacturer's operation guide. For instance, if you just purchased a printer for your computer, you would open up the lid of the computer and install the printer's expansion slot card in an identical fashion.

Once the fixture 8 is installed, replace the lid on the computer. The tether cable 10 with tether cable loop ends 11 on each end can now be attached to the cable attachment loop 13 and to the bottom of the table 16 and locked with a padlock 17.

The personal computer 14 is now secure with all the objects and advantages claimed.

The user will find that the invention is uncommonly strong and effective because the computer housing itself is being used to anchor the invention. The size of the expansion slot opening cover plate 12 is larger than the expansion slot opening 15 such that it cannot be pulled out of the personal computer 14 from the outside. This makes the invention superior to all other tethering methods because uniquely its strength does not rely on the integrity of existing screws like bracket devices and it does not rely on the unpredictable performance of adhesive. It aids the invention that computer housings are generally made of metal due to the electronic grounding requirement of the computer chassis.

By using a tether cable 10 of sufficient length, the user of the personal computer 14 will be allowed to adjust the location of the equipment for personal comfort. Because the mechanical security fixture 8 is located entirely behind the personal computer, the look and feel of the equipment is not modified. And, because no permanent modifications were required to install the invention, there is no concern about violating warranties or damaging the equipment.

Should the equipment need to be relocated, all that is necessary is for the padlock 17 to be unlocked and the equipment moved.

SUMMARY, RAMIFICATIONS, AND SCOPE

Accordingly, the reader will see that the mechanical security fixture of this invention can be used to provide uniquely low cost, easy to install and remarkably secure method to protect virtually all personal computers from relocation or theft.

While the above description contains many specificities, the readers should not construe these as limitations on the scope of the invention, but merely as exemplifications of the preferred embodiments thereof. Those skilled in the art will envision many other variations that are within its scope. As an example, certain families of computers employ expansion slots of a different design. The reader will note that the same principles of this invention will work equally as well with other expansion slot designs. Another variation would be a multipurpose design where the expansion slot might provide an output port for a printer (for example) and also be used as an anchor point for a tether. Or, the expansion slot might have a hardware expansion board installed that requires no input or output connectors to protrude from the expansion slot back panel and also is used as an anchor point for a tether. Or, a manufacturer might wish to provide a cable attachment loop on its own as a selling point without providing a tether cable.

Another variation is a design that uses a bent metal fixture as the tethering element instead of a tethering cable. This variation takes advantage of the expansion slot commonality employed by this invention but uses a different tethering element. The bent metal fixture might be bonded or screwed to the table and designed such that once the computer is slid into the fixture and locked to the expansion slot location, the screws/adhesive are tamper proof. Another variation would be an expansion slot opening cover plate that simply had a hole in it to allow a tether cable to pass from the inside of the personal computer to an outside anchoring location.

Another variation would be two notched expansion slot opening cover plates that would allow a tether cable to utilize the post between expansion slot openings as the attachment location.

Many other variations are possible. For example skilled artisans will be able to change the dimensions and shapes of the various embodiments. They will also be able to make the fixture out of alternative materials such as plastics and various metals. They will be able to make many variations of the expansion slot opening cover plate to accommodate a tether. They will be able to devise methods to secure the invention to a fixed location by using mechanical methods like screws or by bonding the fixture using adhesive. Accordingly, the reader is requested to determine the scope of the invention by the appended claims and through legal equivalents, and not by the examples which have been given.

I claim:

1. A security fixture for a personal computer having an expansion slot chassis, comprising:

an elongated, substantially planar, rigid, unitary main body of substantially constant width and thickness having an upper end and a lower end, the upper end having a relatively short, laterally displaced segment of substantially the same width as the body terminating in a transversely extending flange defining an aperture segment for accepting a screw for mating with an upper surface of the expansion slot chassis; and attachment means in the form of a loop portion connected to the main body for attaching the same to a tether, whereby the security fixture can be installed in the expansion slot chassis and the tether connected to a relatively immovable object thereby substantially securing the personal computer against unauthorized removal.

2. The security fixture of claim 1, wherein the lower end terminates in a reduced width tongue laterally centered with respect to the main body for mating with a slot in a lower surface of the expansion slot chassis, wherein the main body has a height of approximately 10.5 cm, and a width of approximately 1.8 cm, wherein the segment on the upper end is laterally displaced with respect to the main body by approximately 0.3 cm, and wherein the tongue on the lower end has a length of approximately 0.7 cm and a width of approximately 1.0 cm.

3. The security fixture of claim 1, wherein the main body defines an aperture for receiving the attachment means, and wherein the attachment means includes a "T" shaped member having an enlarged portion secured behind the main body, a constricted waist portion captured by the main body, and an enlarged nose section defining an aperture therein for receiving the tether whereby transverse motion of the "T" shaped member through the main body is restricted.

4. The security fixture of claim 3, wherein the main body has two tabs located substantially within the plane of the main body and extending into the main body aperture to secure the "T" shaped member therein.

5. A security fixture for personal computers, comprising:

an elongated, tapered, rigid, unitary main body having a planar front surface terminating in an upper end having a width of approximately 1.9 cm and a lower end having a width of approximately 1.7 cm, the upper end also having an upwardly and laterally outwardly extending upper tab portion in the plane of the front surface, the tab portion having a pair of outwardly extending ears and a width of approximately 2.3 cm, and the ears having a height of approximately 0.8 cm for receipt in an upper portion of a personal computer expansion slot chassis, and attachment means in the form of a loop portion connected to the main body for attaching the same to a tether whereby the security fixture can be installed in the expansion slot chassis and the tether connected to a relatively immovable object thereby substantially securing the personal computer against unauthorized removal.

6. The security fixture of claim 5, wherein the main body defines an aperture for receiving the attachment means, and wherein the attachment means includes a "T" shaped member having an enlarged portion secured behind the main body, a constricted waist portion captured by the main body, and an enlarged nose section defining an aperture therein for receiving the tether whereby transverse motion of the "T" shaped member through the main body is restricted.

7. The security fixture of claim 6, wherein the main body has two tabs located substantially within the plane of the front surface and extending into the main body aperture to secure the "T" shaped member therein.

8. The security fixture of claim 5, wherein the planar front surface has longitudinal rearwardly and transversely extending sidewalls defining a "U" shaped cross section and wherein the lower end has two downwardly depending prongs in the plane of the main body front surface defining an aperture for receipt of an expansion slot retaining screw on a lower portion of a personal computer expansion slot chassis.

9. The security fixture of claim 8, wherein the "U" shaped cross section has a diagonal measure of at least 2 cm so that the fixture can not be forwardly removed through an expansion slot opening in the personal computer.

10. The security fixture of claim 9, wherein the sidewalls have a depth of at least 1.2 cm.

11. A method for manufacturing a personal computer security fixture, comprising the following steps:

constructing a main body plate from a sturdy material having portions thereon adapted for receipt in a personal computer expansion slot opening;

forming an elongated rectangular aperture in the main body with a rearwardly directed tab at an end of the elongated aperture;

positioning a "T" shaped member behind the rectangular aperture, the "T" shaped member having a rear portion larger than the rectangular aperture, a constricted waist portion smaller than the rectangular aperture, and an enlarged nose section forming a pocket for the tab and having a sloped forward edge, the nose section also defining an opening therein for receiving a tether; and forcing the sloped forward edge through the aperture until the pocket formed by the constricted waist is seated in the rectangular aperture with the tab located substantially in the aperture so as to restrain the "T" shaped member against rearward movement.

12. The method of claim 11, wherein during the aperture forming step two tabs are formed in the rectangular aperture, one at each longitudinal end.

* * * * *